United States Patent [19]

Brown et al.

[11] 4,334,832

[45] Jun. 15, 1982

[54] CONSTANT OUTPUT FLUID PUMP

[75] Inventors: Arthur K. Brown; Richard T. Hendrickson; Jerome T. Ewald, all of South Bend, Ind.

[73] Assignee: The Bendix Corporation, Southfield, Mich.

[21] Appl. No.: 127,680

[22] Filed: Mar. 6, 1980

[51] Int. Cl.[3] ..... F04B 1/26

[52] U.S. Cl. ..... 417/218; 417/222

[58] Field of Search ..... 417/212, 213, 218, 222

[56] References Cited

U.S. PATENT DOCUMENTS

| | | | |
|---|---|---|---|
| 2,768,585 | 10/1956 | Hardy | 417/213 |
| 2,845,876 | 8/1958 | Keel | 417/213 |
| 3,096,723 | 7/1963 | Puryear | 417/221 |
| 3,117,457 | 1/1964 | Burt | 417/221 |
| 3,188,971 | 6/1965 | Puryear | 417/300 |
| 3,339,489 | 9/1967 | Mowbray | 417/222 |
| 3,350,881 | 11/1967 | D'Amato | 417/222 |
| 3,676,020 | 2/1970 | Andreason et al. | 417/222 |
| 3,784,327 | 1/1974 | Lonnemo | 417/222 |
| 3,788,773 | 1/1974 | Van der Kolk | 417/213 |
| 4,013,380 | 5/1977 | Pensa | 417/218 |
| 4,137,716 | 2/1979 | Budyich | 60/445 |
| 4,142,841 | 3/1979 | Claar | 417/213 |

FOREIGN PATENT DOCUMENTS

| | | | |
|---|---|---|---|
| 1535205 | 12/1978 | United Kingdom | 417/222 |

*Primary Examiner*—William L. Freeh

*Attorney, Agent, or Firm*—Paul David Schoenle; Ken C. Decker

[57] ABSTRACT

A variable displacement rotary pump includes a tiltable cam plate which varies the pump displacement as a function of the fluid pressure in a control chamber. The pump pumps fluid to a fluid motor via an orifice in an outlet passage. A spool valve meters fluid to the control chamber in response to the differential pressure across the orifice. Pressure on one side of the orifice acts upon the spool valve in a feedback chamber remote from the outlet passage. The orifice is defined by an annular space between the wall of the outlet passage and neck portion of the spool valve. A feedback passage in the spool valve communicates fluid pressure from the one side of the orifice to the feedback chamber. A leakage flow path extends through a bearing to provide for automatic bearing lubrication.

1 Claim, 3 Drawing Figures

CONSTANT OUTPUT FLUID PUMP

BACKGROUND OF THE INVENTION

This invention relates to a variable displacement rotary pump and more particularly, to a control valve which controls the pump displacement in response to the rate of fluid flowing from the pump.

Most currently available vehicle power steering pumps are of a constant displacement design. They provide an essentially constant output fluid flow rate at varying engine speeds by internally bypassing excess flow to the reservoir. However, the power consumed by such pumps increases substantially with increasing engine speed. Typically, these pumps also include a separate high pressure relief valve for bypassing excess flow to the reservoir in response to blockage of a pressure line. In either case, the resulting high fluid flow rate can cause heating of the hydraulic fluid and pump failure. As a result, coolers may be required to maintain the fluid temperature within acceptable limits. Existing variable displacement axial piston-type pumps include a rotating barrel which carries reciprocating pistons engageable with a tiltable swash plate. The swash plate is usually biased to full stroke by spring or hydraulic means and reduction of stroke is accomplished by overcoming the bias load with a control piston operated by system pressure or some fraction of system pressure. In some cases stroke is reduced mechanically via a lever attached to the swash plate trunion. These pumps typically operate at constant speed and flow except where system pressure exceeds a preset level. When this occurs the control piston moves to reduce stroke and flow to maintain the desired system pressure level. The pump and control described herein are designed to maintain a relatively constant fluid flow rate over a wide range of speed and pressure conditions. In the event system pressure exceeds a predetermined level the flow control circuit is biased and displacement is reduced thereby minimizing heat input to the fluid.

SUMMARY OF THE INVENTION

A variable displacement pump includes a housing which encloses a fluid reservoir. A shaft is rotatably mounted on and carried by the housing. The shaft carries a barrel and the barrel carries a plurality of pistons. A tiltable swash plate is disposed at one end of the barrel and is engageable with the pistons. The engagement of the pistons with the swash plate causes them to reciprocate to pump fluid from the reservoir to an outlet via a flow path in response to rotation of the barrel. A control piston is connected to the swash plate and exposed to the fluid pressure in a control chamber. The angle of the swash plate, and thus, the displacement of the pump is controlled by controlling the fluid pressure in the control chamber. A spool valve slidably mounted in a bore in the housing controls the fluid pressure in the control chamber as a function of the differential pressure across an orifice in the flow path. According to the present invention, the orifice in the flow path is formed by the annular space between the wall of the bore and a neck portion of the spool valve. Pressure chambers at opposite ends of the spool valve are exposed to pressure upstream and downstream of the orifice. Fluid pressure on one side of the orifice is communicated to one of the pressure chambers via a feedback passage which is distinct from the flow path. The differential pressure across the orifice acts on both ends of the spool valve to bias the spool valve to maintain a constant output flow. Fluid pressure upstream or downstream of the orifice may be utilized as the operational fluid pressure which is metered to the control chamber by the spool valve.

Accordingly, the present invention provides a flow-rate-controlled variable displacement pump in which the orifice size may be modified without changing the structure of the spool valve.

Use of the upstream orifice pressure permits the use of a smaller diameter control piston to control the pump displacement.

DETAILED DESCRIPTION

Figure 1:
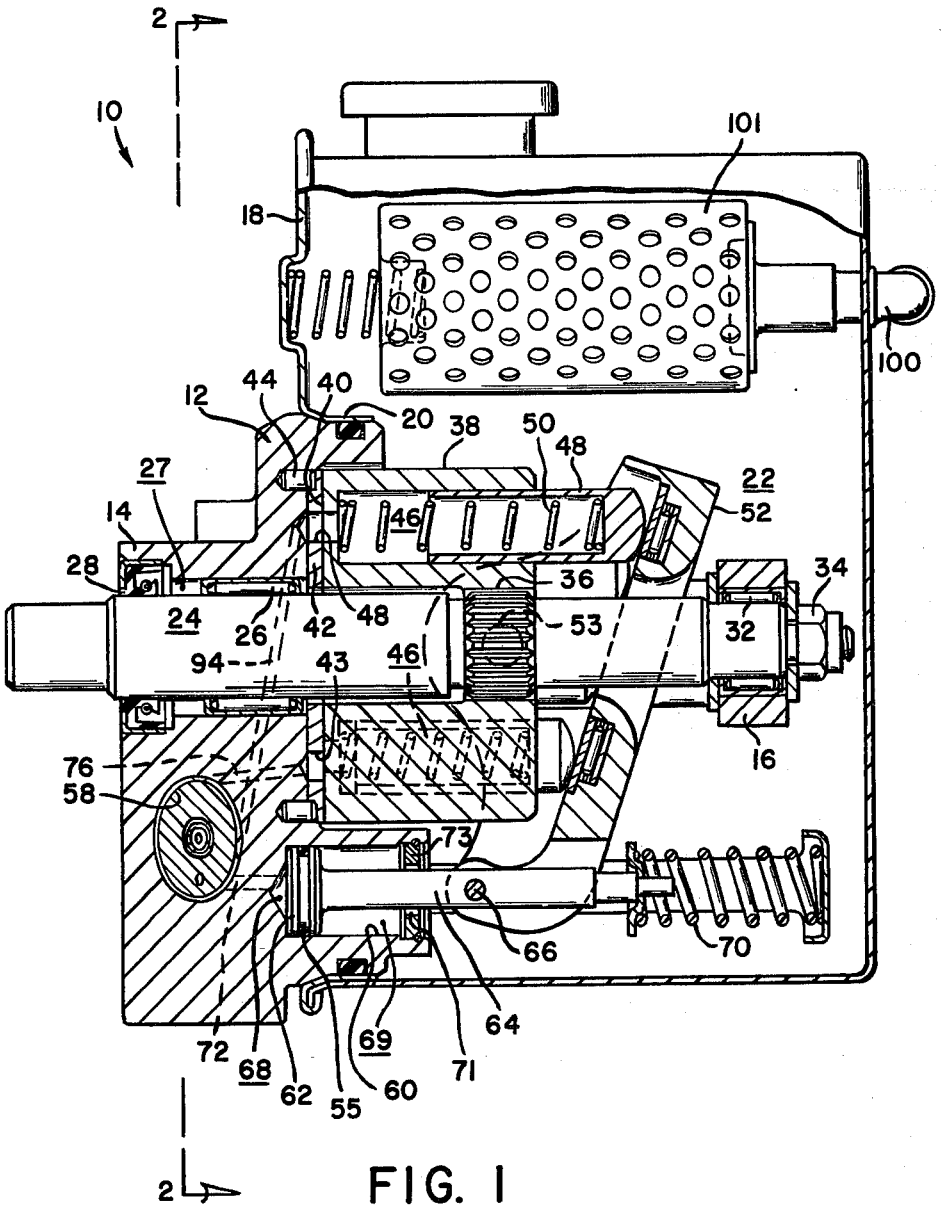
FIG. 1 is a cross-sectional view of a varible displacement pump embodying the present invention.
Figure 2:
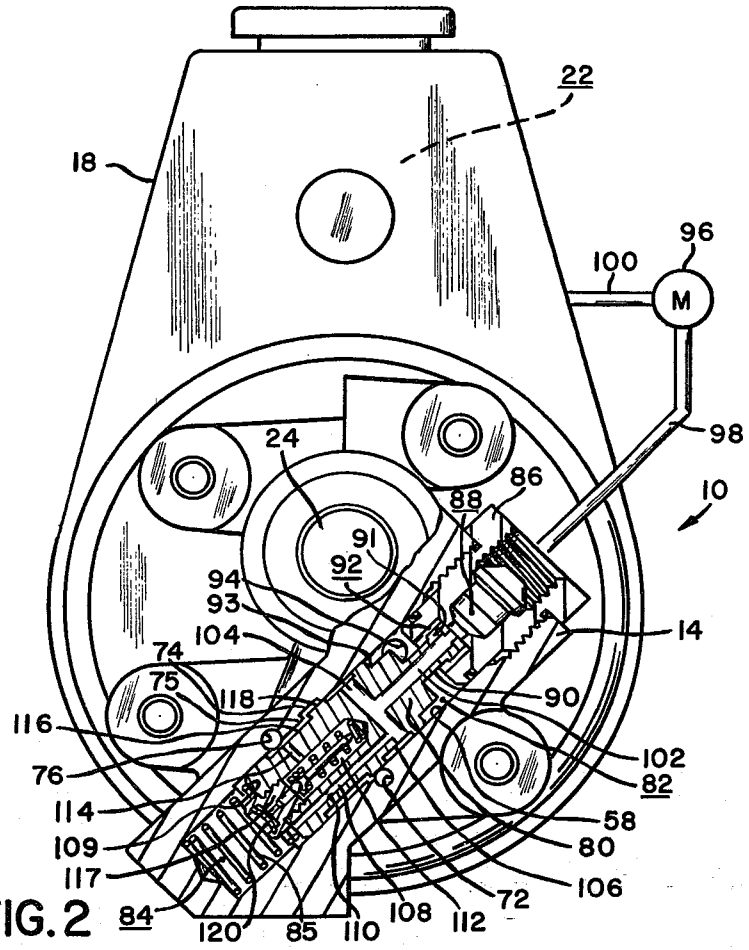
FIG. 2 is a cross-sectional view taken substantially along lines 2—2 of FIG. 1.

Referring to FIGS. 1 and 2, a fluid pump 10 includes a housing 12 with first and second portions 14 and 16 formed as a single piece or casting. A casing 18 fits over seals 20 and encloses a fluid reservoir or case drain 22. A driving shaft 24 extends through housing portion 14 and reservoir 22 and is supported by a bearing 26 carried in a cavity 27. A rubbing seal 28, also carried in cavity 27, prevents fluid loss around shaft 24 to the environment. The outboard end of shaft 24 may be connected to a power source such as a vehicle engine (not shown). The inboard end of shaft 24 is rotatably supported by bearing 32 carried by the second housing portion 16. The shaft 24 is retained against axial movement by nut 34. The shaft 24 includes splines 36 which mate with corresponding grooves in a barrel 38 so that barrel 38 rotates with shaft 24. The end 40 of barrel 38 rubs against a manifold plate 42 which is restrained from rotation by pin 44 which engages the plate 42 and housing 12. The barrel 38 contains a plurality of piston chambers 46 which slidably receive pistons 48. Manifold plate 42 includes an inlet port 43 which communicates fluid from reservoir 22 to chambers 46 and a discharge port 45 into which fluid is discharged from chambers 46 by pistons 48. Springs 50 urge pistons 48 into engagement with a cam or swash plate 52 which is pivotally attached to the housing by pivot 53.

The housing 12 also includes a blind cylindrical bore 60, shown in FIG. 1. A piston 62 slidably mounted in bore 60 and is connected to swash plate 52 by a shaft 64. Piston 62 divides bore 60 into a control chamber 68 and a chamber 69. A spring 70 engages an end of shaft 64 and urges piston to the left viewing FIG. 1. Chamber 69 is communicated with reservoir 22 via damping orifice 71 in end plate 73. Shaft 64 extends from piston 62 through end plate 73 and is pivotally attached to cam plate 52 at pivot 66. The angular position of cam plate 52 is limited to a range of between 2° and 18° with respect to a plane perpendicular to shaft 24 by the engagement of piston 62 with end face 55 of bore 60 and by the engagement of piston 62 with end plate 73.

Housing 12 also includes a cylindrical bore 58. The wall of bore 58 includes an annular groove 74 which separates a pair of lands 73 and 75. Control passage 72 connects control chamber 68 with groove 74. Reservoir passage 76 connects bore 58 with reservoir 22. A spool valve 80 is slidably disposed within bore 58 and separates bore 58 into an inlet chamber 82 and a feedback chamber 84. A spring 85 in feedback chamber 84 urges spool valve 80 upwards to the right viewing FIG. 2. A neck 90 extends from spool valve 80. Neck 90 includes an enlarged diameter portion 91 near an end thereof. A threaded fitting 86 is threaded into the end of bore 58. Portion 91 of neck 90 cooperates with inner diameter portion 93 of fitting 86 to define an annular space or orifice therebetween. Fitting 86 defines an outlet 88 separated from inlet chamber 82 by orifice 92. A discharge passage 94 interconnects inlet chamber 82 with discharge port 45. Annular end face 93 of spool valve 80 is exposed to fluid pressure in inlet chamber 82 upstream of orifice 92. Thus, fluid is pumped from chambers 46 to outlet 88 via a flow path which comprises discharge port 45, discharge passage 94, inlet chamber 82, and orifice 92. Conduit 98 connects outlet 88 with power steering motor 96. Return conduit 100 returns fluid from power steering motor 96 to reservoir 22 via filter 101. Spool valve 80 includes an axial passage 102 which extends through neck 90 and which communicates fluid downstream of orifice 92 with a radial bore 104. Radial bore 104 communicates passage 102 with annular groove 106 on the surface of spool valve 80. A passage 108 with a restriction 110 connects radial bore 104 with feedback chamber 84. Thus, fluid pressure downstream of orifice 92 is communicated to feedback chamber 84 via a feedback passage comprised of passage 102, bore 104, and passage 108. Relief passages 112 and 114 connect feedback chamber 84 with annular groove 116 on the surface of spool valve 80. Groove 116 is positioned so that it is in constant communication with reservoir passage 76. A land 118 separates grooves 106 and 116 and cooperates with the wall of bore 58 to meter fluid between groove 106 and groove 74 and between groove 74 and groove 116. A spring-loaded check valve 117 prevents fluid flow from feedback chamber 84 to relief passage 76 via passages 112 and 114 and groove 116 unless the fluid pressure in feedback chamber 84 exceeds a predetermined pressure, such as could result from a blockage in conduits 98 or 100. Filter element 120 is located between feedback chamber 84 and relief passage 112.

Figure 3:
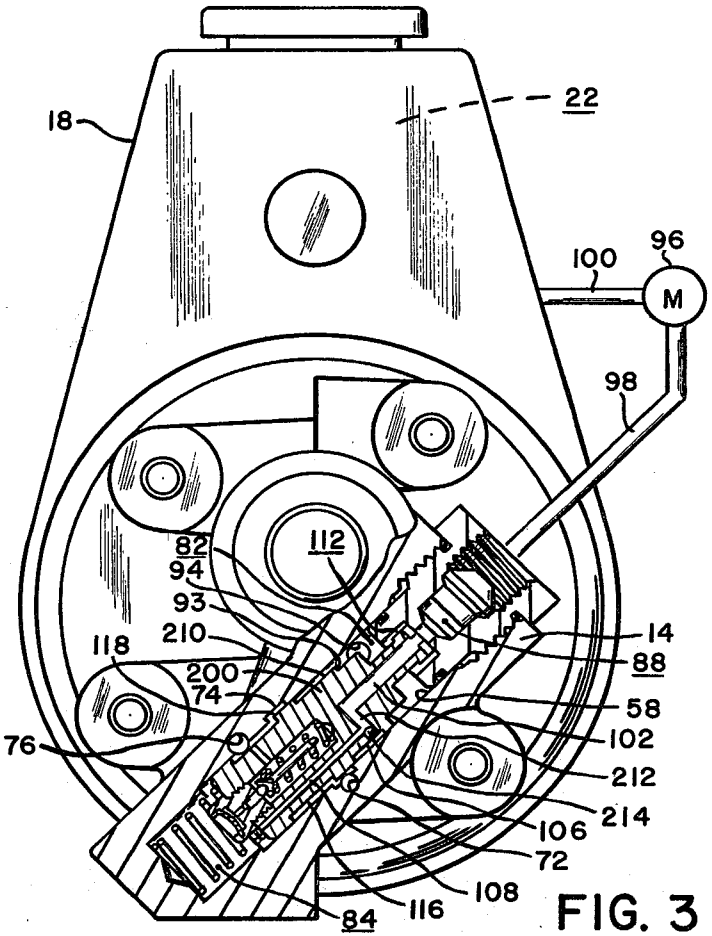
FIG. 3 is a cross-sectional view similar to FIG. 2, but showing an alternate embodiment of applicants' invention.

An alternate embodiment 200 of the valve member is shown in FIG. 3. In the alternate embodiment, annular groove 106 is connected to inlet chamber 82 by an axially extending flat 210 which extends from groove 106 to end face 93 of spool valve 80. Groove 106 is therefore in constant communication with the fluid pressure in inlet chamber 82 upstream of orifice 92. Also, in the alternate embodiment, axial passages 102 and 108 are interconnected by a radial bore 212. An obstruction 214 prevents fluid communication between bore 212 and the outer peripheral surface of spool valve 200. In this manner, fluid pressure in the outlet 88 downstream of orifice 92 is communicated to feedback chamber 84 via passage 102, bore 212 and passage 108. In all other aspects, the valve member shown in FIG. 3 is identical to the valve member 100 shown in FIG. 2. However, with spool valve 200, the land 118 meters fluid from upstream of orifice 92 to control passage 72 via flat 210, groove 106, and groove 74. Land 118 also meters fluid between groove 116 and groove 74.

MODE OF OPERATION

In operation, shaft 24 is rotated, thereby rotating barrel 38. The rotation of barrel 38 causes the reciprocation of pistons 48 because of their engagement with tiltable cam plate 52 and with springs 50. The reciprocation of pistons 48 pumps fluid from reservoir 22 to discharge passage 94 via swash plate 42 in a manner well known in the art as further described in U.S. Pat. No. 3,096,723. Pressurized fluid discharged from chambers 46 is communicated to bearing 26 in bearing cavity 27 via leakage over the peripheral surface of shaft 24. Pressure in the case drain 22 is communicated to bearing cavity 27 over splines 36 whereupon the resulting pressure differential causes a portion of the fluid discharged from chambers 46 to flow through bearing cavity 27 and passage 29 to reservoir 22. This flow lubricates bearing 26 as shaft 24 rotates.

As is also well known in the art, the displacement of pistons 48 within chambers 46 may be controlled by varying the angle of cam plate 52. For example, the further swash plate 52 is tilted from the vertical, viewing FIG. 1, the larger is the amount of displacement of pistons 46 during each revolution of barrel 38. The angle of cam plate 52 is controlled by piston 62 whose position is determined by the fluid pressure in control chamber 68. Viewing FIG. 2, fluid is pumped from chambers 46 to power steering motor 96 via discharge port 45, discharge passage 94, inlet chamber 82, orifice 92, outlet 88, and conduit 98. Fluid is returned from motor 96 to reservoir 22 via conduit 100. The flow of fluid through orifice 92 creates a pressure differential between inlet chamber 82 and outlet 88. The relatively high fluid pressure in inlet chamber 82 upstream of orifice 92 acts directly upon end face 93 of valve member 80. The lower fluid pressure in outlet 88 downstream of orifice 92 is communicated to feedback chamber 84 via passage 102, radial bore 104, and passage 108, where it acts upon end face 109 of valve member 80. If the rate of fluid flow through orifice 92 increases due to a faster rotation of shaft 24, then the differential pressure acting upon valve member 80 increases. Valve member 80 moves downward to the left to compress spring 85 in response to this increased pressure differential. This causes land 118 to move toward land 75 to thereby decrease the communication between reservoir passage 76 and control passage 72 via groove 116 and groove 74. As land 118 moves past land 73 communication between outlet 88 and control passage 72 is increased via passage 102, bore 14, groove 106 and groove 74. This increased communication between control chamber 68 and outlet 88 and the decreased communication between control chamber 68 and reservoir 22 raises the fluid pressure in control chamber 68. The increased pressure in control chamber 68 causes piston 62 to move to the right (viewing FIG. 1) to compress spring 70 until the increased pressure is balanced by spring 70. The rightward movement of piston 62 pivots cam plate 52 counterclockwise. The counterclockwise pivoting of cam plate 52 decreases the displacement of pistons 48 within chamber 46 as barrel 38 rotates, thus decreasing the rate of fluid flow through orifice 92 and counteracting the original flow rate increase.

On the other hand, if the rate of fluid flow through orifice 92 decreases due to a slower rotation of shaft 24, the pressure differential across orifice 92 and across spool valve 80 decreases. This decreased pressure differential allows spring 85 to move valve member 80 upward to the right, viewing FIG. 2. This movement of valve member 80 causes land 118 to move away from land 75 to thereby increase the communication between groove 116 and groove 74. Simultaneously, land 118 moves toward land 73 to decrease the communication between groove 74 and groove 106 and thereby decrease the fluid pressure in control chamber 68. Spring 70 moves piston 62 to the left, viewing FIG. 1, in response to this decreased pressure in control chamber 68, thereby pivoting cam plate 52 clockwise and increasing the displacement of pistons 48 in barrel 38. This increased displacement increases the flow of fluid through orifice 92, thus tending to counteract the original flow decrease. In this manner, applicants' spool valve member 80 operates to maintain a substantially constant rate of fluid flow through orifice 92, despite changes in the speed of rotation of shaft 24. It should be noted, however, that there is a limit to the clockwise pivoting of cam plate 52. As the shaft rotation speed decreases to below a minimum speed, the cam plate 52 cannot pivot clockwise beyond this limit to further increase the pump displacement to compensate for the decreased shaft rotation speed. Thus, below the minimum shaft rotation speed, a substantially constant fluid flow rate cannot be maintained.

If the fluid pressure in inlet chamber 82 or in outlet chamber 88 and thus, in feedback chamber 84, is greater than a predetermined pressure, then springloaded relief valve 117 opens. The opening of relief valve 117 permits flow of fluid from outlet 88 to reservoir 22 via passage 102, bore 104, passage 108, restriction 110, feedback chamber 84, relief passages 112, 114, groove 116, and reservoir passage 76 to thereby relieve the pressure in chambers 82 and 85. The flow of fluid through restriction 110 creates a differential fluid pressure which tends to move valve member 80 to compress spring 85. This movement of valve member 80 causes land 118 to move to increase the pressure in control chamber 68, as previously described. Also, as previously described, the increased fluid pressure in control chamber 68 pivots cam plate 52 counterclockwise to decrease the displacement of the pump 10, thereby further reducing the pressure in chambers 82, 84, and 88.

The alternate embodiment shown in FIG. 3 operates in essentially the same manner, except that inlet chamber 82 upstream of orifice 92, rather than outlet 88 downstream of orifice 92, comprises the source of operating pressure for which metered communication with control chamber 68 is provided by the cooperation of land 118 and groove 106 with groove 74 and lands 73 and 75.

We claim:

1. In a pump, a reservoir, an outlet, and variable displacement pumping means for pumping fluid from said reservoir to said outlet via a flow path, said variable displacement pumping means pumping a varying quantity of fluid as a function of the displacement of said pumping means, fluid pressure responsive means for controlling the displacement of said pumping means as a function of a pressure level communicated to said fluid pressure responsive means, differential pressure responsive valve means controlling communication between said pumping means and said fluid pressure responsive means and between said fluid pressure responsive means and said reservoir whereby said pressure level is controlled as a function of the differential pressure across the valve means, and means for creating a pressure differential across said valve means as a function of the volume of fluid pumped through said flow path by said pumping means, said valve means including a housing defining a bore therewithin and a valve member slidably mounted in said bore and cooperating with the latter to define a pair of pressure chambers, one of said chambers being communicated with the pumping means, said valve means also including passage means distinct from said flow path for communicating said one chamber with the other chamber, said pressure differential being defined by the differential between a fluid pressure in said one chamber and a fluid pressure in said other chamber, said pressure differential creating means includes means defining a flow restricting orifice in said flow path having high and low pressure sides, said high pressure side communicating with said pumping means, said low pressure side communicating with said outlet, and said valve member further comprises a body portion and a neck portion extending from said body portion, said neck portion and a portion of the bore wall surrounding said neck portion defining an annular space therebetween, said annular space comprising said flow-restricting orifice.

* * * * *